United States Patent [19]

Nassenstein et al.

[11] 4,141,315

[45] Feb. 27, 1979

[54] APPARATUS FOR COATING FIBERS, THREADS AND SHEETS

[75] Inventors: Heinrich Nassenstein; Richard Menold; Fritz Feld, all of Leverkusen; Konrad Ellegast, Leichlingen; Roland Weisbeck, Odenthal; Hans G. Gelhaar, Dormagen; Lothar Ruetz, Dormagen; Friedrich W. Elsasser, Dormagen, all of Fed. Rep. of Germany

[73] Assignee: Bayer Aktiengesellschaft, Leverkusen, Fed. Rep. of Germany

[21] Appl. No.: 841,466

[22] Filed: Oct. 12, 1977

Related U.S. Application Data

[62] Division of Ser. No. 472,365, May 22, 1974, abandoned.

[30] Foreign Application Priority Data

May 22, 1973 [DE] Fed. Rep. of Germany ..... 2325827

[51] Int. Cl.[2] ..... B05C 3/12

[52] U.S. Cl. ..... 118/420; 427/434 D

[58] Field of Search ..... 118/405, 420, DIG. 19; 427/175, 373, 434 D, 434 E; 28/169

[56] References Cited

U.S. PATENT DOCUMENTS

| | | | |
|---|---|---|---|
| 2,297,536 | 9/1942 | Buckwalter | 28/169 X |
| 2,914,419 | 11/1959 | Oganowski | 427/175 |
| 2,934,458 | 4/1960 | Budd et al. | 427/175 X |
| 3,230,127 | 1/1966 | Cleereman et al. | 118/405 X |
| 3,485,210 | 12/1969 | Warren | 118/420 |
| 3,697,314 | 10/1972 | Stritzko | 8/19 X |

*Primary Examiner*—Mervin Stein

*Attorney, Agent, or Firm*—Plumley and Tyner

[57] ABSTRACT

This invention relates to an apparatus for applying a thin layer of liquid systems to fibers, threads or sheets which are moved uniformly in a linear direction which comprises continuously foaming the liquid system and bringing the threads, fibers or sheets into contact with the foamed system by a one-way process.

1 Claim, 6 Drawing Figures

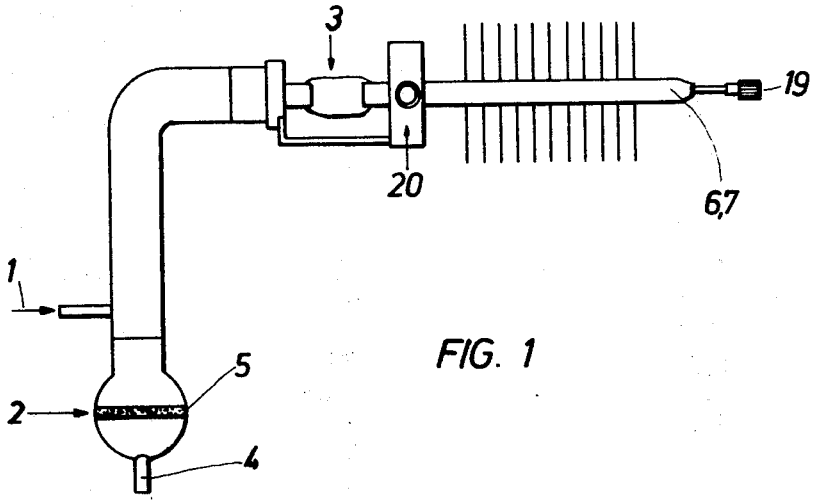
FIG. 1
FIG. 2
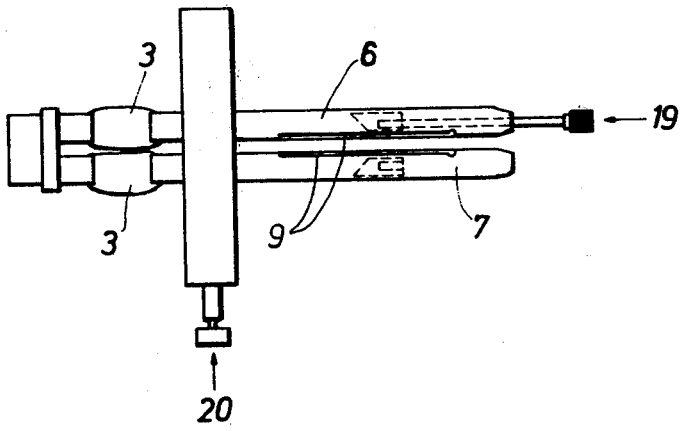

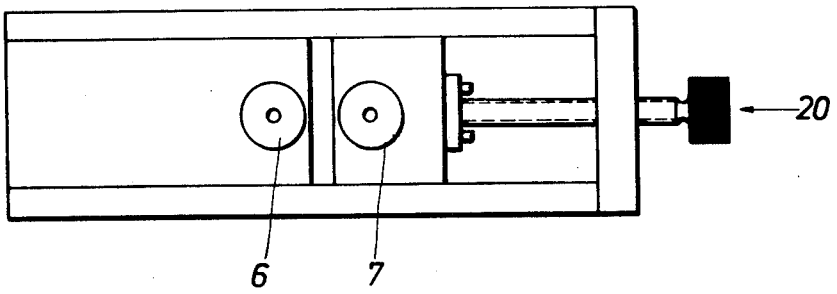
FIG. 3
FIG. 4
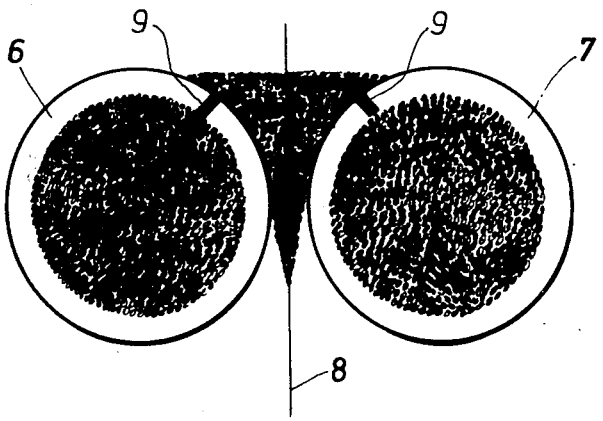

APPARATUS FOR COATING FIBERS, THREADS AND SHEETS

This is a division of application Ser. No. 472,365, filed May 22, 1974, now abandoned.

This invention relates to an apparatus for applying a thin layer of liquid systems to fibres, threads or sheets which are moved uniformly in a linear direction.

The main purpose of coating fibres with spinning preparations is to render the threads more easily slidable. In addition, the coating frequently serves as an antistatic agent. Furthermore, these coatings load the fibres with controlled quantities of water. For these reasons, the coating substances used are almost inevitably oil-in-water emulsions.

The conventional application processes for this type of emulsion are so designed that the threads move past a rotating porous roller and touch it tangentially. The roller dips into a vat containing the emulsion and thus transfers the emulsion to the threads by its rotation. The quantity of emulsion transferred to the threads may be controlled by the speed of rotation of the rollers. The emulsion in the vat is continuously replaced by pumping.

However, when employing these methods of application, the quantity and quality of emulsion applied varies. This is due to the fact that the roller applies the emulsion only on one side of the fibre so that a uniform covering of the whole surface cannot be ensured. Furthermore, the properties of the surface of the roller change in the course of time, e.g. signs of wear appear. Also, the properties of the emulsion change, e.g. due to bacterial action.

The above-described fluctuations in the application of oil result in variations in the friction produced when the threads are stretched. Stretching faults therefore appear which result in variations in the strength of the fibres. In extreme cases, the threads may break. Variations in the amount of water taken up result in variations in the dyeing properties of the fibres.

It is an object of this invention to overcome the above-mentioned disadvantages and difficulties.

It has now been found that emulsions and dressings or, "liquid systems" in general, may be applied uniformly and in controllable quantities to fibres, threads or sheets, moved in a linear direction, if these liquid systems are applied in the form of a foam.

This invention therefore relates to a process for applying a thin layer of liquid systems to fibres, threads or sheets which are uniformly moved in a linear direction, characterised in that the liquid system is continuously foamed and that the fibres, threads or sheets are brought into contact with the foamed system by a one-way process.

For this purpose, the liquid system, e.g. an emulsion, may be foamed by physical means, e.g. by containing the liquid over a frit e.g. glass frit or capillary system, and then blowing gas, e.g. air or nitrogen, through the frit thus forming a foam. The foam is then applied to the fibres or threads by passing them through the cushion of foam which builds up.

The quantity of the liquid system required per unit time to apply a layer of the desired thickness is introduced into the foaming chamber; the liquid level, (liquid/foam iterface), in the foaming part of the apparatus may be maintained by controlling the quantity of gas admitted.

The liquid inlet is connected to a storage vessel which may be raised and lowered. The quantity of liquid fed into the foaming chamber may be regulated by raising the level in the storage vessel in relation to the liquid level in the foaming chamber.

In a continuously operated process, the level of liquid may be maintained by dipping two electrodes into the liquid and connecting them to a voltage source. When the required level is reached, a current flows between the two electrodes. If the liquid drops below the required level, the circuit is broken and a pump is set into operation by an electric switch. This pump continues to pump liquid into the storage vessel until contact is re-established.

In this way, from 0.01 to 10%, by weight, based on the mass of substrates, of the foamed liquid system may be applied uniformly. The thickness of the layer applied is from 0.01 to 100 $\mu$, preferably from 0.1 to 10 $\mu$.

The threads, fibres or sheets which may be dressed by the present process may be either organic or inorganic, synthetic or natural materials. Thus, for example, fibres, threads or sheets of polyamides, polyesters, polyacrylonitriles, polyolefines, carbon, glass, asbestos or aluminium oxide may be successfully coated with numerous conventional preparations by the process of the present invention. The preparations employed may be, for example, lubricants, e.g. mineral, vegetable and animal oils, natural and synthetic waxes or ester oils, (alkyl esters of fatty or dicarboxylic acids), antistatic agents, e.g. salts of partial esters of phosphoric acid with fatty alcohol polyglycol ethers or alkyl phenol-polyglycol esters as well as sulphuric acid esters of the above-mentioned ethylene oxide adducts, emulsifiers, e.g. ethylene oxide adducts and/or propylene oxide adducts of fatty alcohols, fatty acids and fatty amines, wetting agents, e.g. sulphosuccinic acid esters and also bactericides e.g. o-phenyl-phenol and p-chloro-m-cresol.

The process of the present invention has been found to be particularly suitable for the preparation of fibres and threads of polyamide-6. According to the present invention, spinning dressings may be applied at practically any stage of the process of producing the polyamide-6 threads, depending on the manufacturing processes as or after-treatment process as employed. Thus, the foamed dressing may be applied, e.g. immediately after the threads leave the spinning shaft, or after they have been stretched, or before or after they have been textured, or after dyeing, or before or after twisting or winding. In spite of the high speeds of these processes, the liquid systems may be applied uniformly and in the required quantities.

The present process is particularly suitable for applying foamed liquid systems, preferably emulsions, to fibres or threads immediately after they have been produced, preferably immediately after leaving the spinning shaft.

In processes for producing polyamide-6 threads or yarns, the foamed emulsion, (spinning dressing), is preferably applied in quantities of from 0.5 to 6%, by weight, based on the mass of substrate.

A practical embodiment of a coating apparatus which may be employed for this process is depicted in FIGS. 1 to 4. A liquid level of several centimetres is maintained above the frit, 5, by pumping fresh emulsion into the apparatus. Fresh liquid preparation may be introduced into the foaming chamber, 2, through the inlet, 1. Air is blown through the frit from inlet, 4. Foam is formed above the liquid level and forced, under pressure, into the two parallel pipes, 6, and 7, which may be moved in relation to each other to some extent. The threads, 8, which are to be coated run between the two pipes, 6, and 7. Each pipe contains a longitudinal slot, 9, through which the foam is forced. A foam cushion is therby formed between the two pipes and the threads which are to be coated run through this cushion. The threads are thereby uniformly covered with emulsion. The supply of foam may be regulated so that the quantity of foam applied to the threads is exactly the amount required for a satisfactory coating to be formed.

The present process has the added advantage over conventional processes that this dressing process is a one-way process so that undesirable signs of ageing of the emulsion, which occur when the emulsions are applied by means of rollers, are obviated.

FIG. 1 is a side view of a possible embodiment of the apparatus for carrying out the process according to the invention.

FIG. 2 is a top plan view of the apparatus according to the invention.

FIG. 3 shows a transverse section of the apparatus viewed in the direction of the two pipes, 6 and 7.

FIG. 4 also shows a cross-section of the apparatus viewed in the direction of the two pipes, 6 and 7, and illustrates the application of foam to the threads, 8.

Figure 5:
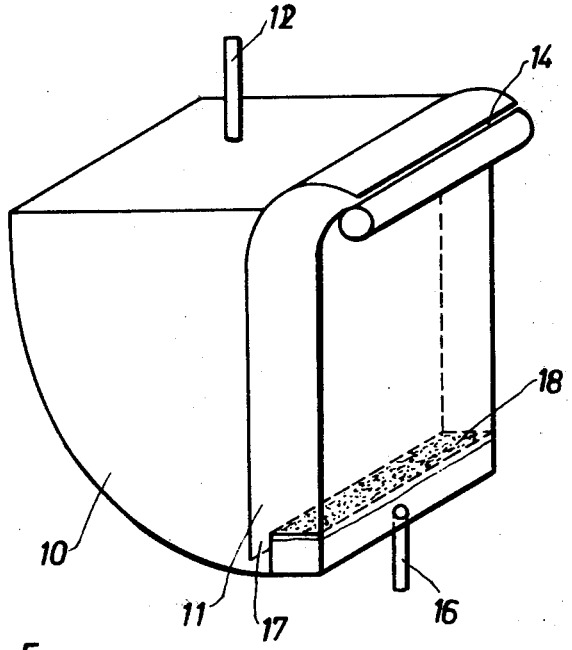

FIG. 5 is a perpective view of another embodiment of the coating apparatus.

Figure 6:
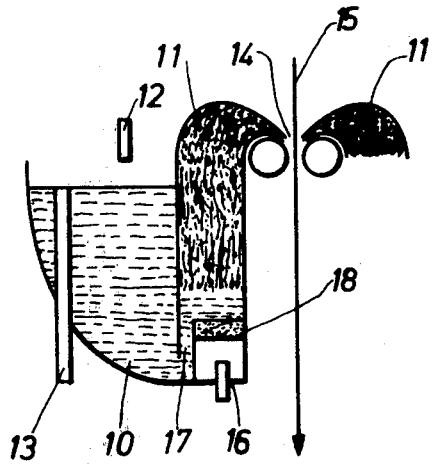

FIG. 6 shows a cross-section of the embodiment of the apparatus illustrated in FIG. 5.

Therefore, a further object of this invention is to provide an apparatus for applying foamed liquids to threads, fibres and sheets, which are moved in a linear direction, which is characterised in that a foaming chamber, 2, which is provided with inlets for a blowing gas, 4, and a liquid, 1, and in which a glass frit, 5 has been inserted is connected to two pipes, 6 and 7, which may be adjusted parallel to each other and which have longitudinally extending slots, 9, situated opposite each other. The adjustment screws, 19 and 20, are for regulating the length of the slots and the distance between the pipes 6 and 7.

The rubber tubing, 3, enables the pipes, 6 and 7, to be adjusted relative to each other.

Another practical embodiment of the coating apparatus for carrying out the process according to the invention is represented in FIGS. 5 and 6. Storage vessel, 10, and foaming apparatus, 11, here form a unit, being connected by way of the inlet, 17. The liquid level in the storage vessel is maintained by constantly pumping the emulsion into the vessel from pipe, 12, excess emulsion being discharged through an overflow pipe, 13. Due to the constant head of liquid in the storage vessel, the foaming part of the apparatus is kept supplied with a constant quantity of emulsion which is formed by the injection of blowing gas, 16, e.g. air. The foam is continuously supplied to a slotted die, 14, where it is applied uniformly to the moving stream of threads, 15.

In order to obtain particularly uniform application, two units may be arranged side by side as depicted in FIG. 6. This arrangement has the advantage that the foam has the same structure at every point of the outlet nozzle since each element of the foam must cover the same path from the moment of its formation until its application to the thread.

Therefore, another object of this invention is to provide an apparatus for carrying out the present process, i.e. for applying foamed liquids to threads, fibres and sheets, which are moved in a linear direction, which is characterised in that it consists of a storage vessel, 10 which is equipped with a liquid supply, 12, and overflow pipe, 13, and which forms a unit with a foaming chamber, 11, by way of the inlet, 17, and the foaming chamber, 11, which is connected to the inlet pipe, 16, for blowing gas by way of a frit, 18, and ends in a slot die, 14.

The following Examples are to further illustrate the invention without limiting it.

EXAMPLES

Threads emerging from spinning machines were dressed with foamed oil-in-water emulsions by the process of the present invention.

EXAMPLE 1

Polyamide-6. Stretched titre dtex 1880/f 140.
Spinning draw-off rate 248 m/min.
(Liquid) emulsion consumption 750 ml/h.
Consumption of air for foaming 6.0 l/h, under normal conditions.

After treatment, the dressed threads contained 3.25% water and 1.34%, by weight, oil. They could be wound-up readily and were very easily treated in a Rieter stretching and twisting machine, (no thread breakages). The ultimate tensile strength was 5 break kilometers higher than that of threads which had been dressed by the roller method and treated in the same manner (81 break kilometers as compared with 76 break kilometers). The quantity of threads of inferior quality was only half that obtained in the comparison material, (0.8% as compared with 1.5%).

EXAMPLE 2

Polyamide-6. Stretched titre 1100/f 63.
Spinning draw-off rate 558 m/min.
(Liquid) emulsion consumption 480 l ml/h.
Consumption of air for foaming 4.0 l/h under normal conditions.

The dressed threads, containing 2.1% water and 0.9% oil, were stretch-textured by a process employing a stilling chamber. The sliding characteristics of the threads were good. Also, there was a distinct improvement in the uniformity of texture and dyeing over the comparison material treated by the roller method.

EXAMPLE 3

Polyamide-6. Stretched titre dtex 22/f 5.
Spinning draw-off rate 1000 m/min.
(Liquid) emulsion consumption 190 ml/h.
Consumption of air for foaming 1.5 l/h, under normal conditions.

The dressed threads contained 3.1% water and 1.2% oil. The material was stretched and then friction-textured by the false twisting process. The uniformity of the crimp and dyeing obtained was better than in the corresponding comparison material which had been dressed by the roller method.

EXAMPLE 4

Polyamide-6. A fixed fibre band with a titre of dtex $10^6$ was after-treated with a brightening agent by the process described. The band was moved at a rate of 80 m per minute. The consumption of emulsion was 4.8 l of liquid per hour; the quantity of air consumed was 38 l per hour, under normal conditions. The application was more uniform than that obtained by the conventional spraying method. A particular advantage of the foam application method was found to be the lower water content of the fibre band.

EXAMPLE 5

Polyamide-6.6. Stretched titre dtex 44/f 9.

Spinning draw-off rate 1400 m/min.

(Liquid) emulsion consumption 630 ml/h.

Consumption of air for foaming 5.0 l/h, under normal conditions.

The dressed threads contained 3.4% water and 1.52% oil. The stretching yield was considerably higher (by a factor of approximately 3), and the physical properties over the length of the threads was more uniform than in the comparison material which had been dressed by the roller method. Furthermore, a knitted sample was found to be more uniform in colour.

EXAMPLE 6

Polyethylene terephthalate. Stretched titre dtex 167/f 34.

Spinning draw-off rate 1100 m/min.

(Liquid) emulsion consumption 170 ml/h. Consumption of air for foaming 1.4, l/h, under normal conditions.

The dressed threads, containing 0.9% oil, were stretch-textured by the false twisting process. The threads were more smooth-running and the fluctuations in bulging were less than in the case of the comparison material which had been dressed by the roller method.

EXAMPLE 7

Polyamide-6. Stretched titre dtex 1880/f 140.

Spinning draw-off rate 284 m/min.

(Liquid) emulsion consumption 500 ml/h.

Consumption of air for foaming 3.5 l/h, under normal conditions.

The dressed threads, containing 2.2% water and 1.0%, by weight, oil, could easily be wound and were suitable for further treatment in a Rieter stretch twisting machine, (no thread breakages). The ultimate tensile strength was 5 Rkm above that of threads which had been dressed by the roller method. The quantity of inferior quality threads was only about half that obtained in the comparison material, (0.8% as compared with 1.5%).

We claim:

1. An apparatus for uniformly applying a coating of a liquid system in a predetermined quantity to a fiber, thread or sheet comprising (a) a foaming chamber including a gas inlet for introducing blowing gas into the chamber, a liquid inlet for introducing a liquid system into the chamber, foaming means for dispersing the gas in the liquid to form a foam on the liquid surface, and outlet means for discharging the foam from the chamber to form a cushion of built-up foam adapted to envelop a linearly moving stream of fibers, threads or sheets, said outlet means comprising a pair of spaced parallel pipes communicating with said foaming chamber, each pipe including a longitudinally-extending slot on the inner surface thereof for discharging the foam to form a cushion between the pipes, and said foaming means comprising a frit disposed above the gas inlet, whereby the liquid system is foamed by disposing the liquid system over the frit and blowing gas through the frit into the liquid system;

(b) means for regulating the spacing between the pipes and means for regulating the length of each slot; and (c) means for moving the foam under pressure from the surface of the liquid through the outlet means.

* * * * *